US007762626B2

(12) United States Patent
Le et al.

(10) Patent No.: US 7,762,626 B2
(45) Date of Patent: Jul. 27, 2010

(54) PEDICURE CHAIR WITH FLIP-UP TRAY

(75) Inventors: Thanh Van Le, Richardson, TX (US); Hung Van Nguyen, Murphy, TX (US)

(73) Assignee: Beauty Mall Ltd., Garland, TX (US)

( * ) Notice: Subject to any disclaimer, the term of this patent is extended or adjusted under 35 U.S.C. 154(b) by 0 days.

(21) Appl. No.: 12/111,662

(22) Filed: Apr. 29, 2008

(65) Prior Publication Data

US 2008/0265632 A1 Oct. 30, 2008

Related U.S. Application Data

(60) Provisional application No. 60/915,107, filed on Apr. 30, 2007.

(51) Int. Cl.
*A47B 83/02* (2006.01)
*A47D 15/00* (2006.01)
*A47C 7/62* (2006.01)

(52) U.S. Cl. ..... 297/173; 297/182; 297/217.1

(58) Field of Classification Search ..... 297/182, 297/173, 217.1; 16/258, 297, 326, 328–332, 16/344, 256, 327, 173; 403/549, 349; 601/157; 4/578.1, 621, 638
See application file for complete search history.

(56) References Cited

U.S. PATENT DOCUMENTS 298,480 A * 5/1884 Lane ..... 16/297
518,130 A * 4/1894 Bartol ..... 297/173
1,203,441 A * 10/1916 Winter ..... 16/256
2,471,183 A * 5/1949 Adams ..... 297/242
3,874,029 A * 4/1975 McCullough ..... 16/329
5,887,317 A * 3/1999 Baker ..... 16/329
D568,485 S * 5/2008 Ton ..... D24/204
D574,502 S * 8/2008 Ton ..... D24/204
7,490,374 B2 * 2/2009 Fugate et al. ..... 4/622

OTHER PUBLICATIONS

Beauty Mall Ltd. Product Literature, available Oct. 2004 (32 pages).

* cited by examiner

*Primary Examiner*—Milton Nelson, Jr.
(74) *Attorney, Agent, or Firm*—Fish & Richardson P.C.

(57) ABSTRACT

A spa chair having an apparatus for extending and retracting a tray from the spa chair is disclosed along with a method for utilizing the spa chair in one or more manicure and/or pedicure procedures. A pivoting mechanism coupled to the tray includes first attaching members for attaching the pivoting mechanism to the spa chair and a second attaching member for attaching the pivoting member to a tray. The pivoting mechanism also includes a shaft retained by the first attaching members and a spring for biasing a shaft and second attaching member in a particular direction. The pivoting mechanism is operable to lockingly secure the tray in at least one of an extended or retracted position.

18 Claims, 8 Drawing Sheets

PEDICURE CHAIR WITH FLIP-UP TRAY

CROSS-REFERENCE TO RELATED APPLICATIONS

This application claims the benefit of U.S. Provisional Application No. 60/915,107, filed Apr. 30, 2007, which is incorporated herein by reference in its entirety.

TECHNICAL FIELD

This disclosure relates to a chair with one or more positionable trays and, more particularly, to a pedicure spa chair having one or more positionable trays.

BACKGROUND

Salons for performing beauty treatments, such as manicures and pedicures, include pedicure spa chairs. The chairs are used to perform manicure procedures on the patrons' hands and pedicure procedures on the patrons' feet. To efficiently perform a manicure or a pedicure procedure, the service provider requires various items close at hand, such as polishes, nail files, trimmers, and other items. As a result, the service provider must provide a surface for the convenient placement of those items. Generally, providing such a surface entails locating a cart or table near the chair during the procedure. Providing such a separate cart or tray requires the salon to procure additional equipment and incur the cost associated therewith along with providing the floor space needed to place this table or cart near the spa chair. Further, the separate cart or tray takes up valuable floor space and may obscure portions of the patron (e.g., may obscure the feet while a manicure is being performed). Because of space constraints and/or because the cart or tray obscures the patron, it is common that only one service provider provides services to the patron at a time. Accordingly, patrons seated in the chairs receive a manicure and a pedicure sequentially (i.e., in series).

SUMMARY

One aspect of utilizing a spa chair to perform a manicure procedure encompasses seating a person into the spa chair. The spa chair may include a seating surface, an arm rest adjacent to the seating surface and protruding upwards, a tray coupled to a tray coupled to the arm rest and operable to be laterally extended and retracted, and a positioning mechanism. The positioning mechanism may include a first portion attached to the arm rest, a second portion attached to the tray, an elongated shaft operably connected the first and second portions, and a biasing member retained on the elongated shaft. The positioning mechanism may be operable to position and lockingly secure the tray in an extended position and in a retracted position. Utilizing the spa chair to perform a manicure procedure may further encompass extending the tray into the extended position, utilizing the tray to perform a manicure procedure, and retracting the tray into the retracted position.

According to another aspect, a spa chair assembly may include a pedestal having a front basin and a spa chair mounted on the pedestal. The spa chair may include a seating surface, an arm rest protruding upwardly and provided adjacent to the base member, a tray provided on the arm rest, and a pivoting mechanism disposed between the tray and the arm rest operable to enable the tray to be protruded from the arm rest in an extended position and to hang downwardly in a retracted position. The seating surface may include a base member and a back rest formed at an angle to the base member. The pivoting mechanism may include an elongated shaft having a longitudinal axis, a pair of first attaching members, a second attaching member, and a locking mechanism to selectively secure the tray in one of extended or retracted positions. Each first attaching member may include a mounting portion attached to one of the arm rest or the tray and a channel receiving the shaft, the shaft pivotable in the channel about the longitudinal axis and slideable in the channel along the longitudinal axis. The second attaching member may include a first portion attached to the other of the arm rest or the tray and a second portion attached to the shaft so that the tray is pivotable along the longitudinal axis and slideable along the longitudinal axis with the shaft relative to the first attaching member. The locking mechanism may include at least one slot formed in one of the first attaching members, a locking pin to engage the at least one slot, the locking pin attached to the shaft proximate the at least one slot, and a biasing element to urge the locking pin into the at least one slot. The locking mechanism may be operable to pivotably fix the first attaching member relative to the second attaching member when the locking pin occupies the at least one slot.

A further aspect may include a method for performing a manicure procedure and a pedicure procedure on an occupant of a spa chair assembly. The method may include seating an occupant in a spa chair assembly having a spa chair, a tray pivotably attached to an arm of the spa chair, and a basin at a base of the spa chair for performing a pedicure procedure on the occupant. The pivotably tray may include a pivoting mechanism operable to enable the pivotable tray to be extended or retracted. The method may further include extending the pivotable tray into an extended position, utilizing the tray to perform a manicure procedure and a pedicure procedure on the occupant concurrently.

The various aspects may include one or more of the following features. extending the tray into the extended position may include displacing the tray in a first direction parallel to the longitudinal axis of the elongated shaft, pivoting the tray about the longitudinal axis into the extended position, and displacing the tray in a second direction parallel to the longitudinal axis of the elongated shaft opposite the first direction. Displacing the tray in the first direction parallel to the longitudinal axis of the elongated shaft may include applying a force contra to a biasing force generated by the biasing member and exceeding the biasing force to displace the tray in the first direction parallel to the longitudinal axis of the elongated shaft to displace a locking member formed on the elongated shaft from a first retaining slot formed on the first portion of the positioning mechanism. Displacing the tray in the second direction parallel to the longitudinal axis of the elongated shaft opposite the first direction may include reducing the force contra to the biasing force generated by the biasing member to displace the tray in the second direction parallel to the longitudinal axis of the elongated shaft and engaging a second slot formed on the first portion of the locking member with the locking pin formed on the elongated shaft. Retracting the tray into the retracted position may include displacing the tray in a first direction parallel to the longitudinal axis of the elongated shaft, pivoting the tray about the longitudinal axis into the retracted position, and displacing the tray in a second direction parallel to the longitudinal axis of the elongated shaft opposite the first direction. Displacing the tray in the first direction parallel to the longitudinal axis of the elongated shaft may include applying a force contra to a biasing force generated by the biasing member and exceeding the biasing force to displace the tray in the first direction parallel to the longitudinal axis of the elongated shaft to displace a locking member formed on the elongated shaft from a second retaining slot formed on the first portion of the positioning mechanism. Displacing the tray in the second direction parallel to the longitudinal axis of the elongated shaft opposite the first direction may include reducing the force contra to the biasing force generated by the biasing member to displace the tray in the second direction parallel to the longitudinal axis of the elongated shaft and engaging a first slot formed on the first portion of the locking member with the locking pin formed on the elongated shaft.

The various aspects may also include one or more of the following features. The at least one slot may be formed in an end surface of the first attaching member. The at least one slot may include first and second slots that are circumferentially offset from each other. The tray is in an extended position when the locking pin occupies the first slot, and the tray is in a retracted position when the locking pin occupies the second slot. A sliding displacement of the tray along an axis of the shaft corresponding to removing the locking pin from the at least one slot may compress the biasing element, and a sliding displacement of the tray along the axis of the shaft corresponding to inserting the locking pin into the at least one slot may decompress the biasing element. The second attaching member may be disposed between the pair of first attaching members, and the biasing element may be retained on the shaft between one of the first attaching members and the second attaching member. The biasing element may exert a separation force between the one of the first attaching members and the second attaching member along an axis of the shaft. The pair of first attaching members may be aligned along a longitudinal axis of the shaft. The biasing element may be a coil spring retained on the shaft between one of the first attaching members and the second attaching member. A first end of the coil spring may abut the one of the first attaching members, and a second end of the coil spring may abut the second attaching member. The coil spring may be in compression when the locking pin is retained in the at least one slot.

The various aspects may further include one or more of the following features. Extending the pivotable tray into the extended position may include exerting a force in a direction substantially parallel to a pivoting axis of the pivotable tray against a bias force until the pivotable tray is in a unlocked state, pivoting the pivotable tray about the pivoting axis into the extended position, and releasing the force against the bias force so that the bias force returns the tray into a locked state. Retracting the pivotable tray into the retracted position may include exerting a force in a direction substantially parallel to the pivoting axis of the pivotable tray against a bias force until the pivotable tray is in an unlocked state, pivoting the pivotable tray about the pivoting axis into the retracted position, and releasing the force against the bias force so that the bias force returns the tray into a locked state. Utilizing the tray to perform a manicure procedure and a pedicure procedure on the occupant concurrently may include placing, on the pivotable tray, at least one of an appendage of the occupant or an instrument or a chemical for performing the manicure procedure on the occupant. Utilizing the tray to perform a manicure procedure and a pedicure procedure on the occupant concurrently may include placing, on the pivotable tray, at least one of an instrument or a chemical for performing the pedicure procedure on the occupant.

The details of one or more implementations are set forth in the accompanying drawings and the description below. Other features, objects, and advantages will be apparent from the description and drawings, and from the claims.

DETAILED DESCRIPTION

Figure 1:
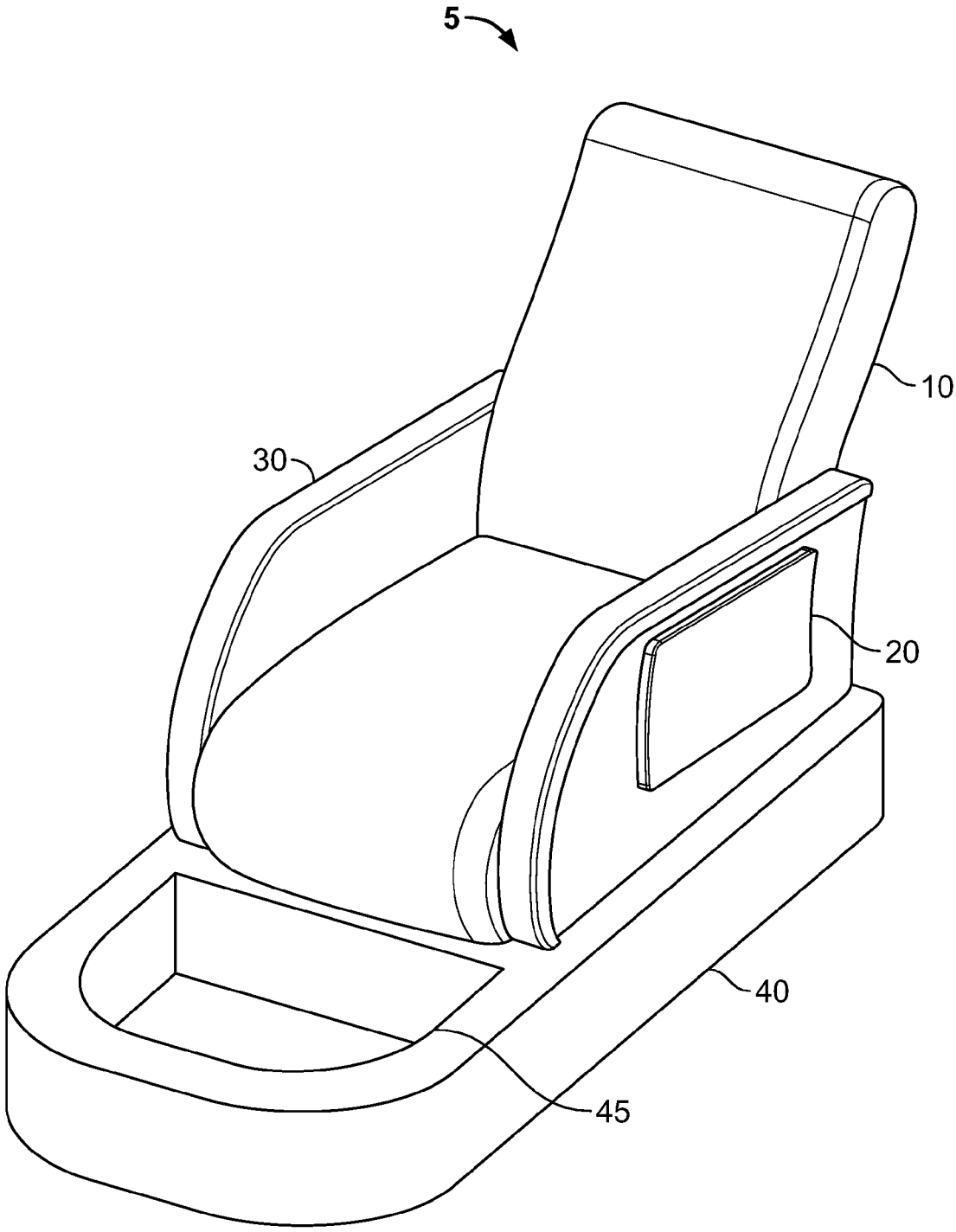
FIGS. 1 and 2 show perspective views of a spa chair assembly having a flip-up tray in a retracted and an extended position, respectively.
Figure 2:
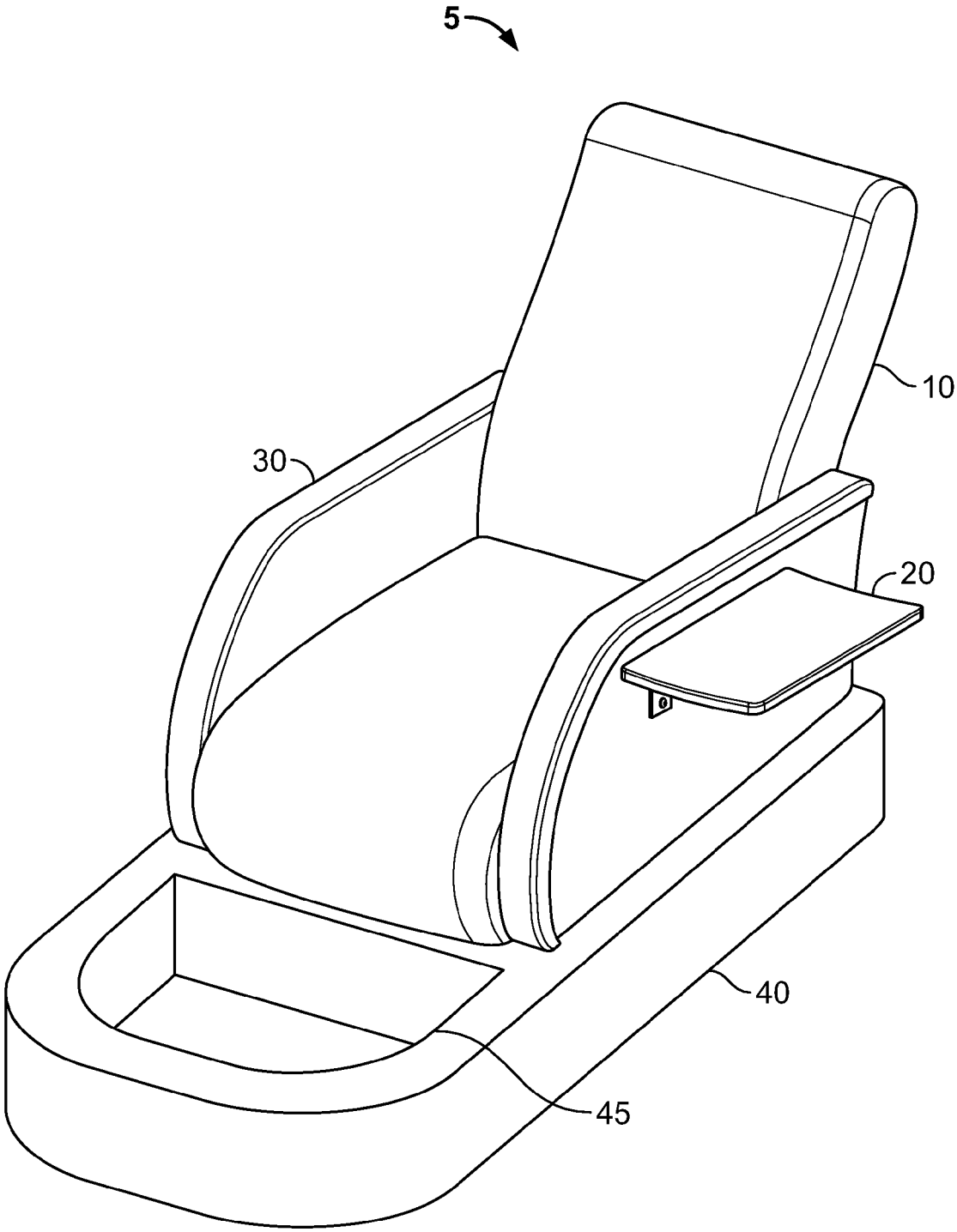

FIGS. 1 and 2 illustrate an example implementation of a pedicure spa chair assembly (interchangeably referred to as "chair assembly") 5, including a spa chair (interchangeably referred to as "chair") 10 with one or more flip-up or pivotable trays ("trays") 20 installed. The chair 10 may include a substantially planar tray 20 on each arm 30 of the chair 10 and, in some implementations, each tray 20 may be extended and retracted individually. Alternately, the chair 10 may include a tray 20 on only a single arm 30. The spa chair assembly 10 may also include a pedestal 40 having a foot basin 45 for performing a foot soak or other treatment on an occupant on the chair 10. For example, the chair 10 may be mounted on top of a pedestal that includes the foot basin 45, which may be filled with liquid water or any other appropriate substance used for the treatment of a person's feet. Generally, the chair 10 may be used by a person receiving a pedicure procedure or a manicure procedure. Moreover, the chair 10 may be utilized by a service provider to provide manicure and pedicure procedures concurrently. Thus, according to some implementations, an occupant of the chair 10 may receive both a pedicure and manicure, such as trimming, shaping and painting nails or applying nail prosthetics, concurrently thus saving the occupant valuable time. The chair 10 may also include other features, such as a massaging mechanism for massaging an occupant sitting in the chair 10.

Figure 3:
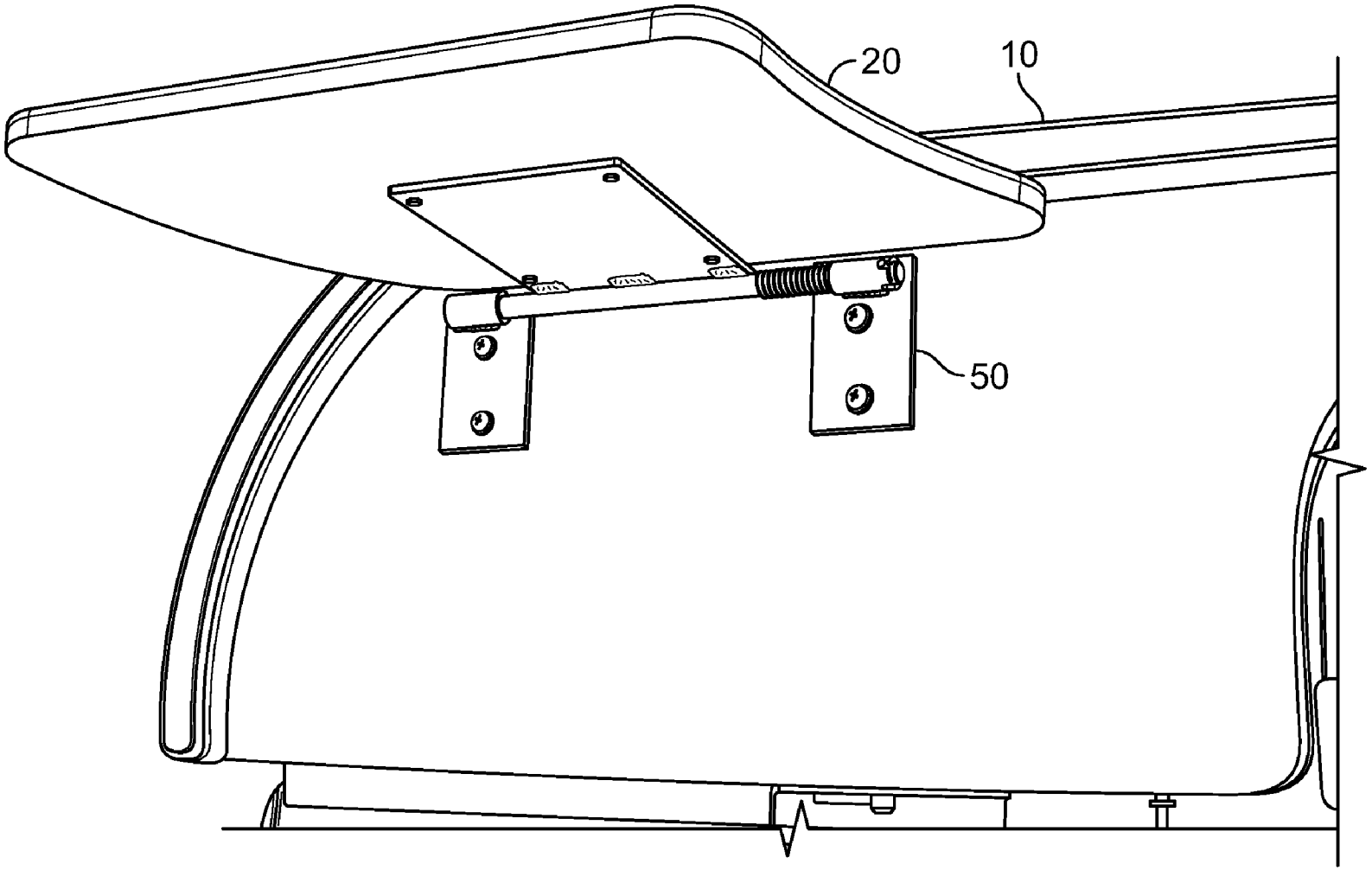
FIG. 3 shows a pivoting mechanism for extending and retracting the flip-up tray.
Figure 4A:
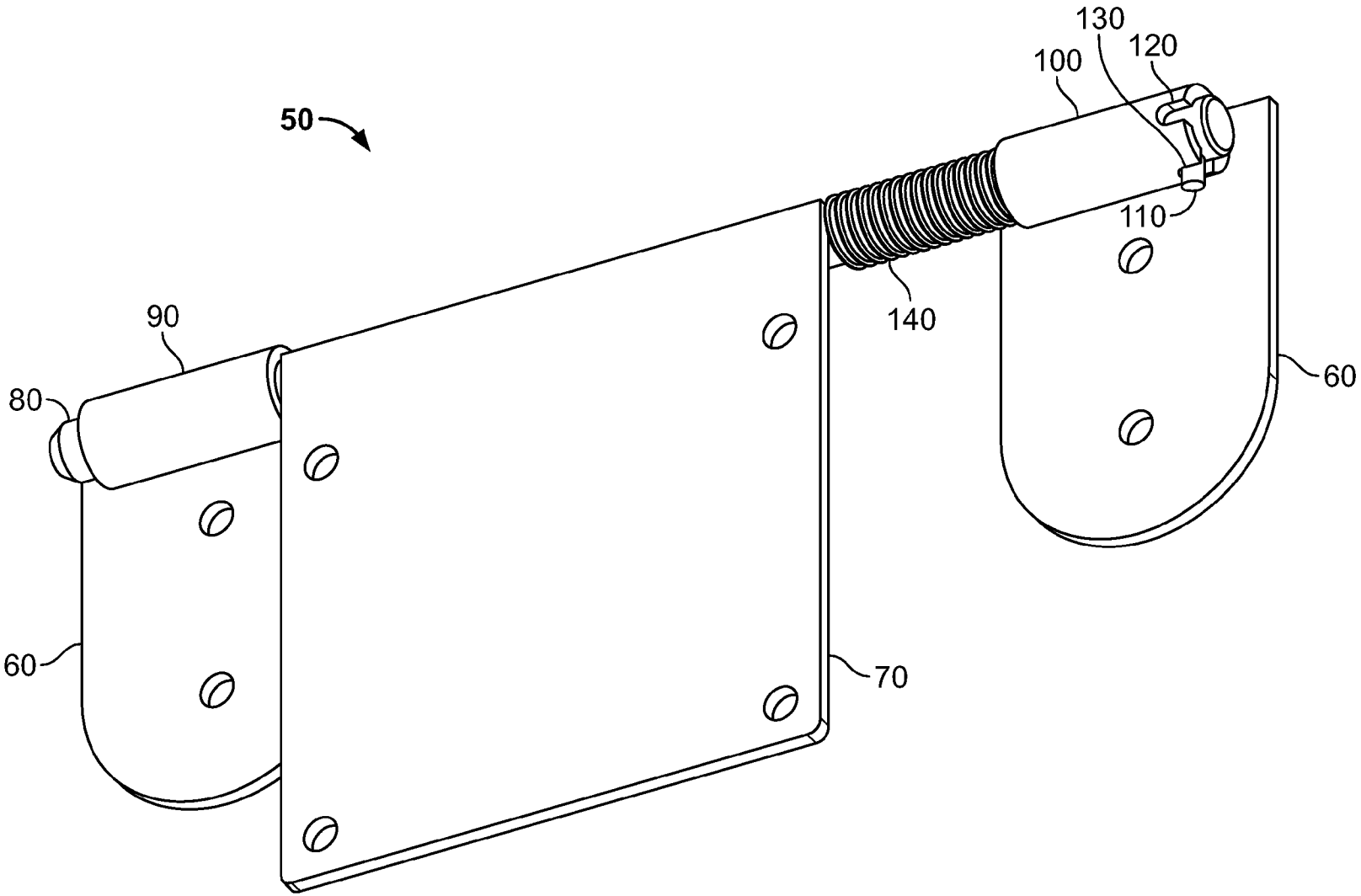
FIGS. 4A-4D show the pivoting mechanism at various positions.
Figure 4B:
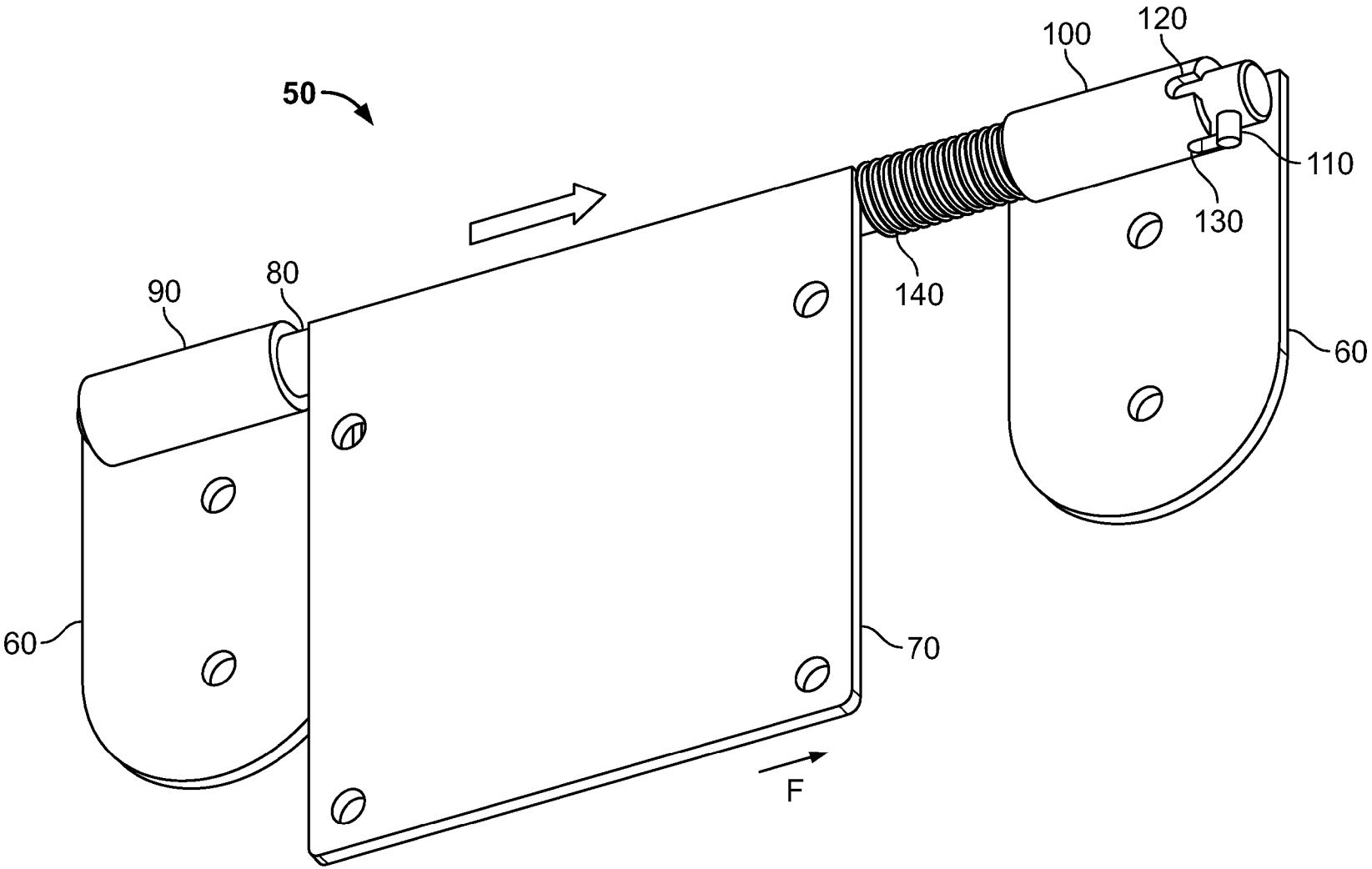
Figure 4C:
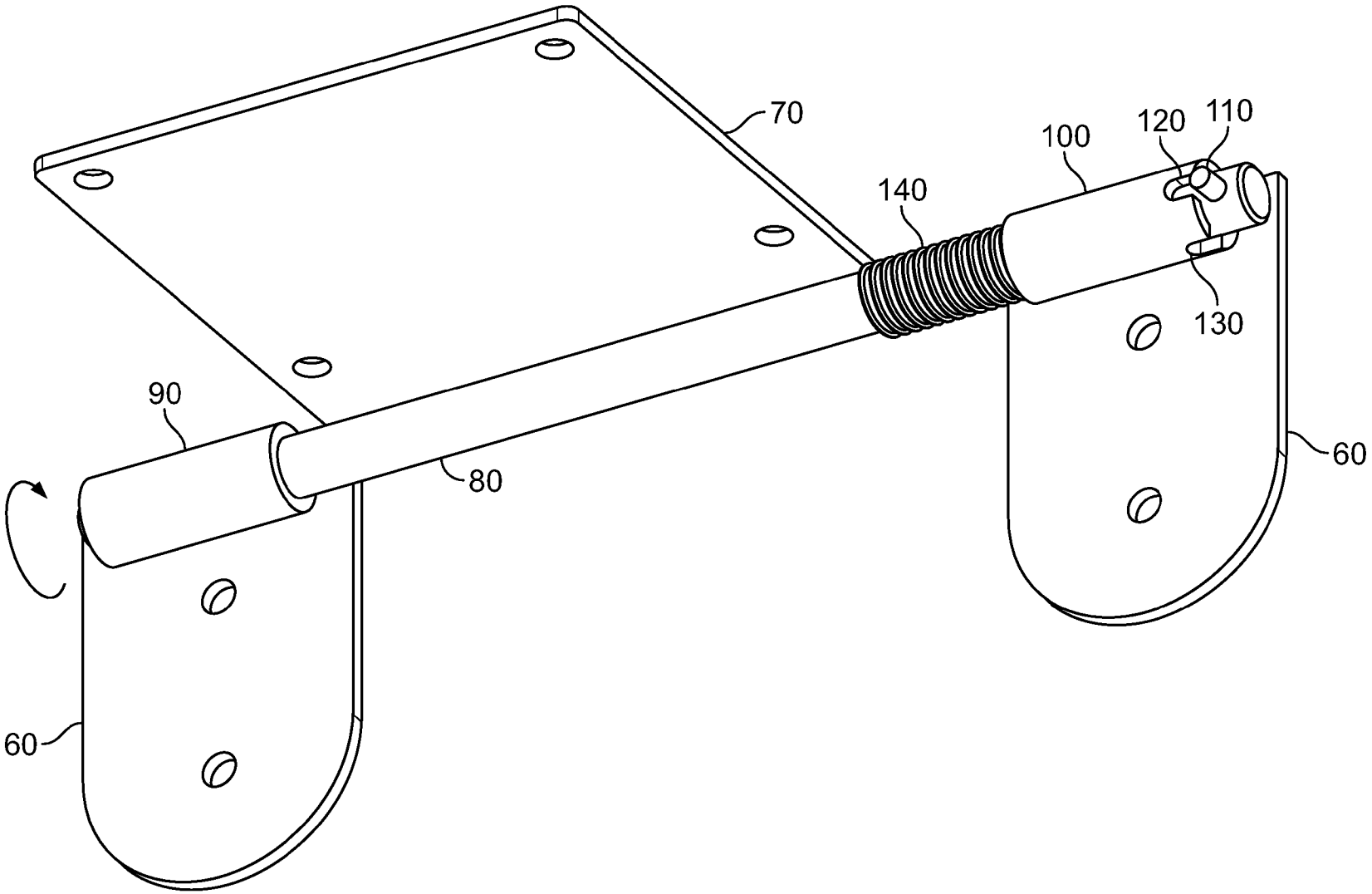

FIG. 3 illustrates a detail view of a tray 20 in a laterally extended position. The tray 20 may be attached to the chair 10 with a pivoting mechanism 50. The pivoting mechanism 50 provides for extending and locking the tray into and extended position as well as retracting the tray 20 and locking the tray 20 in a retracted position. In certain instances, the pivoting mechanism 50 can be configured to omit locking the tray 20 in a retracted position. The locking mechanism 50 allows the tray 20 to be raised into an upright or laterally extended position so that a occupant sitting in the chair may rest his or her arm or hand on the tray 20 and/or to place items utilized by another, such as a manicurist, for performing a manicure treatment on the seat occupant. Other items may also be placed on the tray. Referring to FIGS. 4A-4C, the pivoting mechanism 50 may include attaching members 60 and an attaching member 70. The attaching members 60 may be used to secure the pivoting mechanism 50 to a portion of the chair 10, such as to the arm 30. The attaching members 60 may be secured in any desired manner, such as with bolts, screws, pins, adhesive, welding, etc. The attaching member 70 may be attached to the tray 20, such as an undersurface of the tray 20. The pivoting mechanism 50 also includes a shaft 80 retained within cylindrical members 90, 100 that are secured to the attaching members 60. The cylindrical member 90, 100 form an interior channel in which a portion of the shaft is retained. Also, although shown as cylindrical in shape, the cylindrical members 90, 100 may have non-cylindrical portions and have any desired cross-sectional shape, such as a square, rectangular, triangular, oval, etc. The shaft 80 is pivotable within the cylindrical members 90, 100. The cylindrical members 90, 100 may be integrally formed with the attaching members 60 or the cylindrical members 90, 100 may be secured to the attaching members 60, such by welds, bolts, screws, adhesive, etc. The attaching member 70 is attached to the shaft 80. A portion of the shaft 80 extending beyond the cylindrical member 100 includes a locking pin 110. The locking pin 100, as illustrated, is a protrusion that extends substantially radially outward from the shaft 80. As shown, the locking pin 100 extends perpendicularly from a longitudinal axis of the shaft 80, although the locking pin 100 may extend at any angle. The locking pin 110 is adapted to be received in slots formed in the cylindrical member 100. As shown in FIGS. 4A-4C, the pivoting mechanism 50 includes slots 120 and 130, which may be offset from each other by 90° along a circumference of an end surface of the cylindrical member 100. However, the slots 120, 130 may be provided at any location along a circumference of the cylindrical member 100 and offset by more or less than 90°. Slot 120 corresponds to the tray 20 being in an extended position and slot 130 corresponds to the tray 20 being in a retracted position. Thus, when the locking pin 110 occupies the slot 120, the tray 20 is in an extended position, and, when the locking pin 110 occupies the slot 130, the tray 20 is in a retracted position. However, the pivoting mechanism 50 may include other slots to secure the tray 20 in other positions.

The pivoting mechanism 20 may also include a biasing element 140, such as a spring (e.g., a coil spring) although other types of biasing elements can be used, such as one or more resilient members. According to some implementations, the biasing element 140 is retained on the shaft 80 between the attaching member 70 and the cylindrical member 100. The biasing element 140 biases the second attaching member 70 and shaft 80 in a direction towards the cylindrical member 90.

Figure 4D:
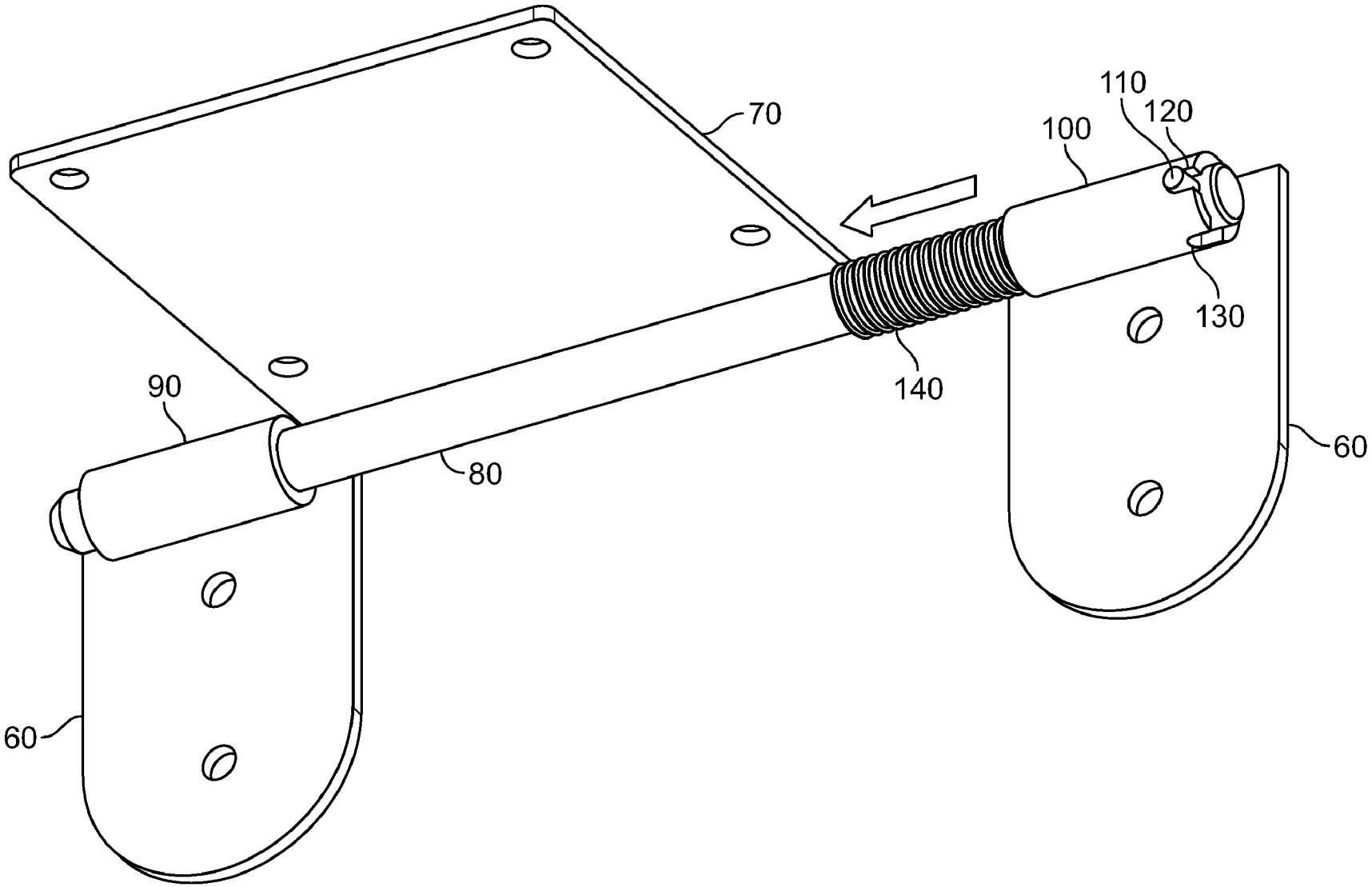

FIGS. 4A-4D illustrate operation of the pivoting mechanism 50 for moving the tray 20 between a laterally extended and retracted position. FIG. 4A illustrates the locking mechanism 50 in a retracted or stowed position in which the locking pin 110 is retained within the slot 130. When the locking pin 110 is retained within the slot 130, the shaft 80 and second attaching member 70 are prevented from pivoting. Thus, tray 20 attached to the second attaching member 70 is prevented from pivoting but, rather, is locked into the retracted position. Additionally, in the retracted position, an end surface of the attaching member 70 may abut an end surface of the cylindrical member 90. In FIG. 4B, the shaft 80 and attaching member 70 are shown displaced towards the cylindrical member 100, causing the biasing element 140 to be compressed and dislodging the locking pin 110 from the slot 130. In FIG. 4C, and the shaft 80 and the attaching member 70 have been pivoted from the retracted position and are now shown in the extended position. In the extended position, the locking pin 110 aligns with the slot 120. Referring to FIG. 4D, the shaft 80 and attaching member 70 are shown displaced towards the cylindrical member 90 and the locking pin 110 disposed in the slot 120. Therefore, when a user, such as an occupant of the seat or a manicurist/pedicurist desires to extend the tray 20 from a retracted position, a force F is applied to move the tray 20 towards the cylindrical member 100, causing the locking pin 110 to be withdrawn from the slot 130 and the biasing element 140 to be compressed. The tray 20 is pivoted into the extended position so that the locking pin 110 aligns with the slot 120. The applied force F is removed, causing the biasing element 140 to expand and urging the shaft 80 and attaching member 70 towards the cylindrical member 90. Additionally, the locking pin 110 slides into the slot 120, the attaching member 70 and a tray 20 attached thereto are in the extended position. Consequently, the tray 20 is prevented from further rotation. According to some implementations, in a retracted position, the tray 20 may be substantially vertical to a ground surface or resting against the arm 30 of the chair 10, while, in an extended position, the tray 20 may be substantially horizontal to a ground surface or perpendicular to the arm 30 of the chair 10 or in a position operable to support the hand or arm of the chair occupant. Returning the tray 20 from the extended position to the retracted position may be accomplished by reversing the order of operations described above.

Figure 5:
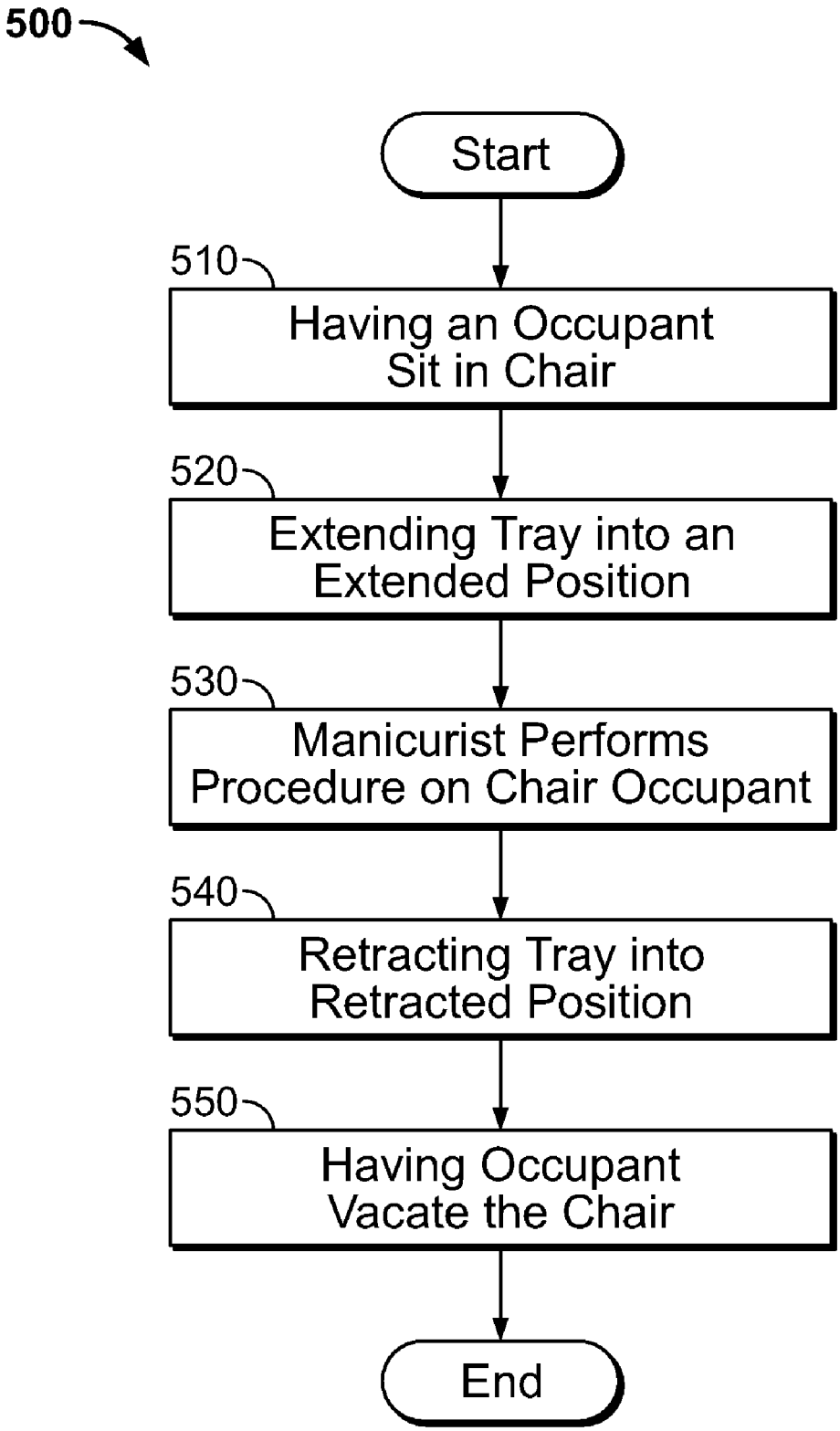
FIG. 5 is a flowchart for a method of using the spa chair assembly having a flip-up tray in performing a pedicure and/or manicure procedure on an occupant of the chair assembly.

FIG. 5 shows an example method 500 for utilizing the chair assembly (for example, the pedicure spa chair assembly 5 of FIG. 1) in a pedicure and/or manicure procedure. At 510, a chair occupant occupies the chair (e.g. seated by the service provider) of the chair assembly in preparation for performing a manicure and/or pedicure procedure. Prior to sitting in the chair, the occupant may remove his or her shoes, for example when the spa chair includes a basin (such as basin 45, described above) and/or when a pedicure procedure is to be performed on the occupant. At 520, the tray (such as tray 20, shown in FIG. 1) may be laterally extended, such as by using the pivoting mechanism 50 described above. At 530, the tray may be utilized for performing a manicure procedure on the hands of the occupant. For example, the tray may be used to rest the hand of the occupant thereon or the tray may be used to place one or more products, such as instruments, polishes, cleaners, etc., on the tray before, during, and/or after performing the manicure procedure. The tray provides a convenient working area close to the occupant's hands, eliminating the need for a separate pedestal, tray, or table and saving limited space near the occupant. Alternately or in addition, the tray may be used to store items used for a pedicure procedure. In certain instances, if a service provider performing a manicure uses a separate pedestal, tray or table, it may interfere with a second service provider's ability to access the occupant's feet. Additionally, the tray protrudes laterally outward from the arm of the chair and does not obscure the occupant. Thus, in the method, while the occupant is receiving a manicure procedure, the occupant may also be concurrently receiving a pedicure procedure, such as a nail painting. At 540, the tray is retracted, such as when the manicure treatment and/or pedicure treatment is completed, and, at 550, the occupant may vacate the chair.

A number of implementations have been described. Nevertheless, it will be understood that various modifications may be made without departing from the spirit and scope of the present disclosure. For example, a spa chair having an arm that pivots in two different directions may also be used to perform manicure and pedicure services simultaneously. The arm may be pivoted upwardly in a first direction to permit the occupant to sit in the chair. The arm may be pivoted downwardly to form an arm of the chair. Thereafter, the arm may be pivoted transversely to the first direction to form a tray. Other implementations are also possible and included within the scope of the present disclosure.

What is claimed is:

1. A method utilizing a spa chair to perform a manicure procedure, the method comprising:

seating an occupant into the spa chair, the spa chair comprising:

a seating surface, an arm rest adjacent to the seating surface and protruding upward from the seating surface, a tray coupled to the arm rest and operable to be laterally extended and retracted, and a positioning mechanism, the positioning mechanism comprising:

a first portion attached to the arm rest;

a second portion attached to the tray; and an elongated shaft connecting the first and second portions, the positioning mechanism operable to lockingly secure the tray between an extended position and a retracted position;

displacing the tray in a first direction parallel to the longitudinal axis of the elongated shaft;

pivoting the tray about the longitudinal axis into the extended position;

displacing the tray in a second direction parallel to the longitudinal axis of the elongated shaft opposite the first direction;

utilizing the tray to perform a manicure procedure; and retracting the tray into the retracted position.

2. The method of claim 1, wherein displacing the tray in the second direction parallel to the longitudinal axis of the elongated shaft opposite the first direction comprises:

reducing a force contra to a biasing force generated by a biasing member proximate the elongate shaft to displace the tray in the second direction parallel to the longitudinal axis of the elongated shaft; and engaging a second slot formed on the first portion of the positioning mechanism with a locking pin formed on the elongated shaft.

3. The method of claim 1, wherein displacing the tray in the first direction parallel to the longitudinal axis of the elongated shaft comprises:

applying a force contra to a biasing force generated by a biasing member proximate the elongate shaft; and exceeding the biasing force to displace the tray in the first direction parallel to the longitudinal axis of the elongated shaft to displace a locking member formed on the elongated shaft from a first retaining slot formed on the first portion of the positioning mechanism.

4. A method utilizing a spa chair to perform a manicure procedure, the method comprising:

seating an occupant into the spa chair, the spa chair comprising:

a seating surface, an arm rest adjacent to the seating surface and protruding upward from the seating surface, a tray coupled to the arm rest and operable to be laterally extended and retracted, and a positioning mechanism, the positioning mechanism comprising:

a first portion attached to the arm rest;

a second portion attached to the tray; and an elongated shaft connecting the first and second portions, the positioning mechanism operable to lockingly secure the tray between an extended position and a retracted position;

extending the tray into the extended position;

utilizing the tray to perform a manicure procedure;

displacing the tray in a first direction parallel to the longitudinal axis of the elongated shaft;

pivoting the tray about the longitudinal axis into the retracted position; and displacing the tray in a second direction parallel to the longitudinal axis of the elongated shaft opposite the first direction.

5. The method of claim 4, wherein displacing the tray in the second direction parallel to the longitudinal axis of the elongated shaft opposite the first direction comprises:

reducing a force contra to a biasing force generated by a biasing member proximate the elongate shaft to displace the tray in the second direction parallel to the longitudinal axis of the elongated shaft; and engaging a first slot formed on the first portion of the positioning member with a locking pin formed on the elongated shaft.

6. The method of claim 4, wherein displacing the tray in the first direction parallel to the longitudinal axis of the elongated shaft comprises:

applying a force contra to a biasing force generated by a biasing member proximate the elongate shaft; and exceeding the biasing force to displace the tray in the first direction parallel to the longitudinal axis of the elongated shaft to displace a locking member formed on the elongated shaft from a second retaining slot formed on the first portion of the positioning mechanism.

7. A spa chair assembly for use by a service provider in providing pedicure and manicure services, comprising:

a pedestal having a front basin operable to hold a liquid;

a spa chair mounted to the pedestal, the spa chair comprising:

a base member defining a seating surface proximate the front basin;

a back rest having a back rest surface residing at an obtuse angle to the seating surface;

an arm rest protruding upwardly from the base member and adjacent the seating surface;

a tray coupled to the arm rest; and a pivoting mechanism disposed between the tray and the arm rest operable to enable the tray to be protruded from the arm rest in a laterally extended position and to hang downwardly in a retracted position, the pivoting mechanism comprising:

an elongated shaft having a longitudinal axis;

a first attaching member comprising:

a mounting portion attached to one of the arm rest or the tray; and a channel receiving the shaft, the shaft pivotable in the channel about the longitudinal axis and slideable in the channel along the longitudinal axis;

a second attaching member comprising:

a first portion attached to the other of the arm rest or the tray; and a second portion attached to the shaft so that the tray is pivotable about the longitudinal axis and slideable along the longitudinal axis with the shaft relative to the first attaching member; and a locking mechanism that selectively secures the tray in the laterally extended position, the locking mechanism comprising:

a slot formed in the first attaching member;

a locking pin receivable in the slot, the locking pin attached to the shaft proximate the slot; and a biasing element that tends to urge the locking pin into the slot, the locking mechanism operable to pivotably fix the first attaching member relative to the second attaching member when the locking pin occupies the slot.

8. The spa chair assembly of claim 7, wherein a sliding displacement of the tray along the axis of the shaft corresponding to removing the locking pin from the slot compresses the biasing element and wherein a sliding displacement of the tray along the axis of the shaft corresponding to inserting the locking pin into the slot decompresses the biasing element.

9. The spa chair assembly of claim 7, wherein the slot is formed in an end surface of the first attaching member.

10. The spa chair assembly of claim 9, wherein the slot comprises a first slot and the locking mechanism further comprises a second slot formed in the first attaching member circumferentially offset from the first slot, wherein the tray is in an extended position when the locking pin occupies the first slot, and wherein the tray is in a retracted position when the locking pin occupies the second slot.

11. The spa chair assembly of claim 7, wherein the second attaching member is disposed between a pair of first attaching members, and the biasing element is retained on the shaft between one of the first attaching members and the second attaching member, and wherein the biasing element exerts a separation force between the one of the first attaching members and the second attaching member along the axis of the shaft.

12. The spa chair assembly of claim 11, wherein the pair of first attaching members are aligned along the longitudinal axis of the shaft.

13. The spa chair assembly of claim 11, wherein the biasing element is a coil spring retained on the shaft between the first attaching member and the second attaching member.

14. The spa chair assembly of claim 13, wherein a first end of the coil spring abuts the first attaching member and a second end of the coil spring abuts the second attaching member, and wherein the coil spring is in compression when the locking pin is retained in the slot.

15. A method for performing a manicure procedure and a pedicure procedure on an occupant of a spa chair assembly, the method comprising:

seating an occupant in a spa chair assembly, the spa chair assembly comprising:

a spa chair;

a tray pivotably attached to an arm of the spa chair by a pivoting mechanism operable to enable the pivotable tray to be laterally extended or retracted; and a basin at a base of the spa chair for performing a pedicure procedure on the occupant;

exerting a force in a direction substantially parallel to a pivoting axis of the pivotable tray against a bias force until the pivotable tray is in an unlocked state;

pivoting the pivotable tray about the pivoting axis into the laterally extended position; and releasing the force against the bias force so that the bias force returns the tray into a locked state; and utilizing the tray in performing a manicure procedure while concurrently performing a pedicure procedure on the occupant.

16. The method of claim 15, wherein utilizing the tray in performing a manicure procedure while concurrently performing a pedicure procedure on the occupant comprises:

placing, on the pivotable tray, at least one of an instrument or a chemical for performing the pedicure procedure on the occupant.

17. The method of claim 15, wherein utilizing the tray in performing a manicure procedure while concurrently performing a pedicure procedure on the occupant comprises:

placing, on the pivotable tray, at least one of an appendage of the occupant or an instrument or a chemical for performing the manicure procedure on the occupant.

18. The method of claim 15 further comprising retracting the pivotable tray into the retracted position, wherein retracting the pivotable tray comprises:

exerting a force in a direction substantially parallel to the pivoting axis of the pivotable tray against a bias force until the pivotable tray is in an unlocked state;

pivoting the pivotable tray into the retracted position; and releasing the force against the bias force so that the bias force returns the tray into a pivotably locked state.

* * * * *

UNITED STATES PATENT AND TRADEMARK OFFICE

CERTIFICATE OF CORRECTION

PATENT NO. : 7,762,626 B2
APPLICATION NO. : 12/111662
DATED : July 27, 2010
INVENTOR(S) : Thanh Van Le It is certified that error appears in the above-identified patent and that said Letters Patent is hereby corrected as shown below:

Col. 8, in Claim 5, Line 4, delete "member" and insert --mechanism--, therefor.

Signed and Sealed this

Second Day of November, 2010

David J. Kappos

David J. Kappos
*Director of the United States Patent and Trademark Office*